US005247888A

United States Patent [19]

Conil

[11] Patent Number: 5,247,888

[45] Date of Patent: Sep. 28, 1993

[54] SEMI COMBUSTIBLE CARTRIDGE

[75] Inventor: Bernard Conil, Bergerac, France

[73] Assignee: Societe Nationale des Poudres et Explosifs, Paris, France

[21] Appl. No.: 718,390

[22] Filed: Jun. 20, 1991

[30] Foreign Application Priority Data

Jun. 25, 1990 [FR] France ..... 90 07928

[51] Int. Cl.[5] ..... F42B 5/18

[52] U.S. Cl. ..... 102/431; 102/430; 102/467; 102/469; 102/700

[58] Field of Search ..... 102/430–433, 102/700, 466, 467, 469, 470, 472; 285/921, 305, 321

[56] References Cited

U.S. PATENT DOCUMENTS

| | | | |
|---|---|---|---|
| 2,812,958 | 11/1957 | Rogers | 285/304 |
| 2,935,945 | 5/1960 | Brady | 102/469 |
| 3,170,401 | 2/1965 | Johnson . | |
| 3,224,373 | 12/1965 | Kramer . | |
| 3,320,886 | 5/1967 | DeLuca | 102/431 |
| 3,401,632 | 9/1968 | Griffith . | |
| 3,978,793 | 9/1976 | McLennan et al. | 102/432 |
| 4,276,830 | 7/1981 | Pastora Alice . | |
| 4,526,411 | 7/1985 | Bartholomew | 285/921 |
| 4,635,974 | 1/1987 | Moussaian | 285/921 |
| 4,671,179 | 6/1987 | Synofzik et al. . | |
| 4,884,829 | 12/1989 | Funk et al. | 285/321 |
| 5,052,304 | 10/1991 | Rahnenfuhrer et al. | 102/431 |

FOREIGN PATENT DOCUMENTS

| | | | |
|---|---|---|---|
| 524509 | 12/1953 | Belgium . | |
| 0158121 | 10/1985 | European Pat. Off. . | |
| 1006140 | 4/1952 | France . | |
| 1078338 | 11/1954 | France | 102/469 |
| 1391733 | 2/1965 | France | 102/430 |
| 1405996 | 6/1965 | France . | |
| 2152029 | 4/1973 | France . | |

*Primary Examiner*—Harold J. Tudor

*Attorney, Agent, or Firm*—Cushman, Darby & Cushman

[57] ABSTRACT

Cartridge case member with a combustible tube, ammunition with a semicombustible cartridge case incorporating this member and process for filling this ammunition.

The present invention relates to the field of combustible ammunition and relates more particularly to that of dart-shell semicombustible ammunition.

The invention relates to a cartridge case member (3) with a combustible tube (6) comprising a bottom (7) which has a central opening (8) and a side opening (9). A hollow component (4) enters the said member (3) through the central opening (8) without obstructing the side opening (9). This hollow component (4) is a shell of revolution which comprises, over its entire height, a central cavity on the wall of which are arranged means (18) for fastening a separate component.

The invention also relates to semicombustible ammunition (1) comprising a member (3) according to the invention.

Finally, the invention relates to a process for assembling such ammunition, a process according to which, after the ignition tube (34) and the shell have been fastened to the member (3), the latter is filled with powder by virtue of the side opening (9) and the metal base (2) is fitted only afterwards by snapping on.

5 Claims, 5 Drawing Sheets

SEMI COMBUSTIBLE CARTRIDGE

FIELD OF THE INVENTION

The present invention relates to the field of combustible ammunition. More precisely the invention relates to a cartridge case member with a combustible tube and to ammunition with a semicombustible cartridge case incorporating this member. The invention also relates to a process for filling such semicombustible ammunition.

BACKGROUND AND DESCRIPTION OF THE PRIOR ART

In conventional artillery it is known to employ ammunition with metal cartridge cases, made of brass in most cases.

While the metal cartridge case has undoubted advantages where the robustness and the leaktightness at the rear of the shell at the time of firing are concerned, it nevertheless has many disadvantages.

Being made of metal, it does not take part in the combustion of the propellent charge and represents a useless dead space from the viewpoint of ballistics. Furthermore, after the propellent charge has burnt, it contains many toxic gases, and this represents a certain handicap when it has to be extracted and kept inside a closed enclosure such as, for example, a battle tank. Finally, since the metal of which it consists is generally a copper-based alloy, its manufacturing cost is high.

To get rid of these disadvantages, one solution consists in employing entirely combustible cartridge cases. The combustible cartridge case, in fact, offers the twin advantage of taking part in the combustion of the propellent charge and, in doing so, of contributing additional energy and of leaving no solid space containing toxic gases after combustion. For these reasons, wholly combustible cartridge cases are extensively called for in modern ammunition. Nevertheless, in comparison with metal cartridge cases, these present a disadvantage where the leaktightness during firing at the rear of the shell is concerned. In fact, precisely because they are destroyed at the time of firing, combustible cartridge cases do not contribute any additional leaktightness to that offered by the breech closure device. In the usual weapon systems the closure device generally ensures effective leaktightness up to $3\times10^8$ Pa, or 3000 bars. This limit is wholly acceptable in the case of most conventional shells and allows a wholly combustible cartridge case to be employed. However, this limit is insufficient for some shells such as the dart shells intended for piercing armour and which must be fired at higher pressures which can be up to $7\times10^8$ Pa, or 7000 bars. In this case, if the breech of the weapon system is not to be modified and made heavier, the metal cartridge case offers the advantage of contributing the indispensable addition of leaktightness due to its metal base.

With this type of shell, a particularly advantageous solution is provided by semicombustible cartridge cases consisting, on the one hand, of a case-shaped combustible member and of a metal base. In this type of cartridge case the combustible case takes part in the combustion of the propellent charge, contributing additional energy and avoiding the retention of a large quantity of toxic gases, while the metal base ensures effective leaktightness at the rear of the projectile, even at very high pressures. There are essentially two types of semicombustible cartridge cases in existence. In the first type the combustible member is simply a combustible tube obtained advantageously by spiralling combustible paper, the joint with the metal base being made by means of an additional bottom part, as described, for example, in the addition 87,428 to French Patent 1,349,818. In the second type, described, for example, in French Patent 2,365,096, the combustible member comprises both a tubular part and a bottom which can fit directly into the metal base. Such a combustible member is preferably obtained by felting, by starting with an aqueous slurry containing the materials of which the combustible member is composed.

As can be seen from the abovementioned patents, the fastening of the combustible member to the metal base is effected by means of a fastening component, generally a fastening ring, which binds the bottom of the combustible member around a hollow internal collar carried by the metal base. This solution is practical, but necessarily means that the interior of the combustible member must be free at the time of the fastening of the metal base, to allow the introduction and the positioning of the said fastening component. Consequently, in currently known semicombustible cartridge cases the propellent powder can be introduced only after the metal base has been fitted. Furthermore, a correct ignition of large-calibre ammunition requires the presence of an ignition tube situated in the extension of the said hollow collar carried by the metal base and which, for obvious safety reasons, must preferably be fitted before the powder is introduced.

Under these conditions it is therefore not possible to ensure a correct filling with propellent powder of semicombustible ammunition through the bottom of the latter.

On the other hand, it is easy to fill semicombustible ammunition with powder through the open end of the tube of the combustible member, which is away from the metal base, and then to fit the shell. This solution is suitable in the case of conventional shells which have a rounded bottom which does not enter far into the combustible tube.

On the other hand, a new difficulty arises with dart shells which have finning entering deeply into the combustible tube. For obvious safety reasons these shells must be fastened to the combustible member before the powder is introduced. With this type of ammunition, since the introduction of the powder must be performed after the metal base and the shell have been positioned, this introduction can be performed only through a side opening made in the wall of the combustible tube, an opening which must then be closed again. Combustible materials do not lend themselves well to a cutout of this type, and the automation of the manufacture of dart-shell semicombustible ammunition is at present practically impossible.

SUMMARY OF THE INVENTION

The objective of the present invention is precisely to do away with the difficulties described above, by proposing a cartridge case member with a combustible tube which can be filled with powder through the bottom after the shell and the ignition tube o the emplacement for the latter have been fitted, but before fitting the metal base, so as to permit easy manufacture of dart-shell semicombustible ammunition, capable of being automated.

The invention relates, therefore, to a cartridge case member with a combustible tube comprising especially a combustible tube and a bottom which has a central opening, characterised in that the said bottom comprises a separate side opening beside the said central opening and in that, integrally attached to the said bottom, there is a hollow component which enters the said cartridge case member through the said central opening without obstructing the said side opening and which comprises, over its entire height, a central cavity bounded by an internal wall on which means are arranged, permitting separate component to be fastened inside the said central cavity.

According to a preferred alternative form of the invention the said bottom consists of an elastic material chosen from the group consisting of the products of polymerisation of chloroprene, of neoprene, or of mixtures based on ethylene and propylene, and comprises a sealing lip.

The invention also relates to ammunition comprising especially a semicombustible cartridge case, a projectile and an ignition tube, characterised in that the said semicombustible cartridge case consists of a cartridge case member according to the invention and of a metal base which carries a central ferrule which enters the cavity of the said hollow component and which comprises fastening means complementing those carried by the said hollow component.

Finally, the invention also relates to a process for assembling ammunition according to the invention, characterised in that, after the space needed for the ignition tube has been reserved inside the said member and after the projectile has been fastened to the end of the combustible tube away from the said bottom, the said member is filled with propellent powder by virtue of the said side opening and in that the metal base is fitted only afterwards.

Thus, by virtue of the presence at the bottom of the cartridge case member of, on the one hand, a side opening and, on the other hand, a hollow component carrying internal fastening means, it is possible, after the space needed for the ignition tube has been reserved and after the projectile has been fastened, to fill the cartridge case member with propellent powder, this being done throughout its useful volume, and to fasten the metal base only afterwards. The ignition tube can thus be fitted after filling and fitting of the metal base, which permits unprimed ammunition to be transported and stored.

A simple means, which can easily be made industrially, of producing dart-shell semicombustible ammunition thus becomes available by virtue of the invention.

BRIEF DESCRIPTION OF THE DRAWINGS

The invention, with its preferred alternative forms, is described below in detail with reference to FIGS. 1 to 7.

DETAILED DESCRIPTION OF THE INVENTION

Figure 1:
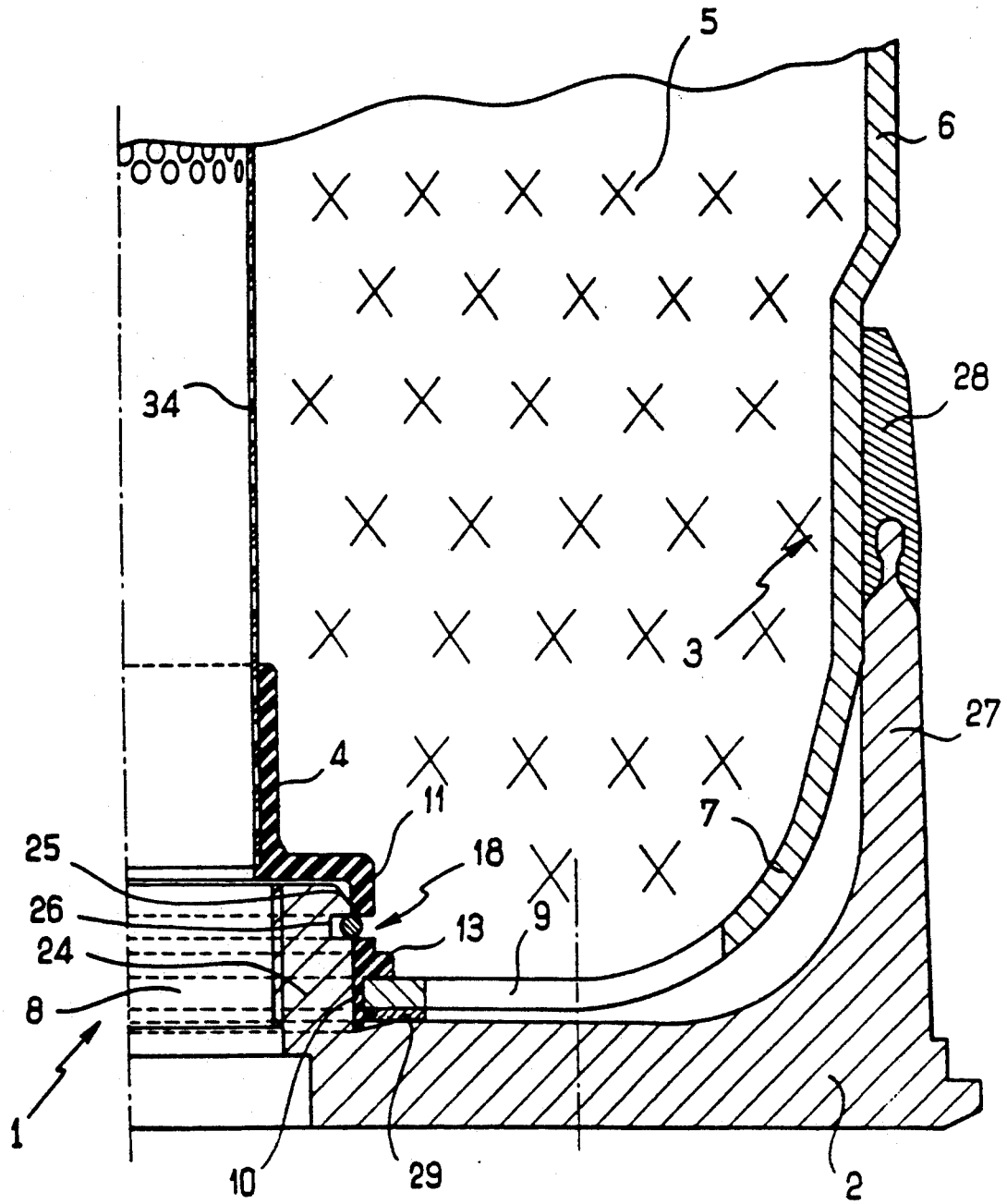
FIG. 1 shows, in partial section, a semicombustible cartridge case according to the invention.

FIG. 1 shows, in partial section, the lower part of a semicombustible cartridge case 1 according to the invention. This cartridge case consists chiefly of a metal base 2, a member 3 with a combustible tube and a hollow component 4. The semicombustible cartridge case is filled with propellent powder 5.

The cartridge case member 3 with a combustible tube comprises especially a combustible tube 6 and a bottom 7, also combustible, forming a single component. This single component is advantageously obtained by a felting technique, by starting with an aqueous slurry containing a mixture of nitrocellulose fibres and cellulose fibres. The bottom 7 has a circular central opening 8.

Beside the said central opening 8, the bottom 7 comprises, in a characteristic manner, a separate side opening 9.

A hollow component 4 enters the said cartridge case member 3 through the said central opening without obstructing the said side opening 9 and is attached to the said bottom 7.

The said hollow component 4 comprises, over its entire height, a central cavity bounded by an internal wall on which means are arranged permitting a separate component to be fastened inside the said central cavity.

Figure 3:
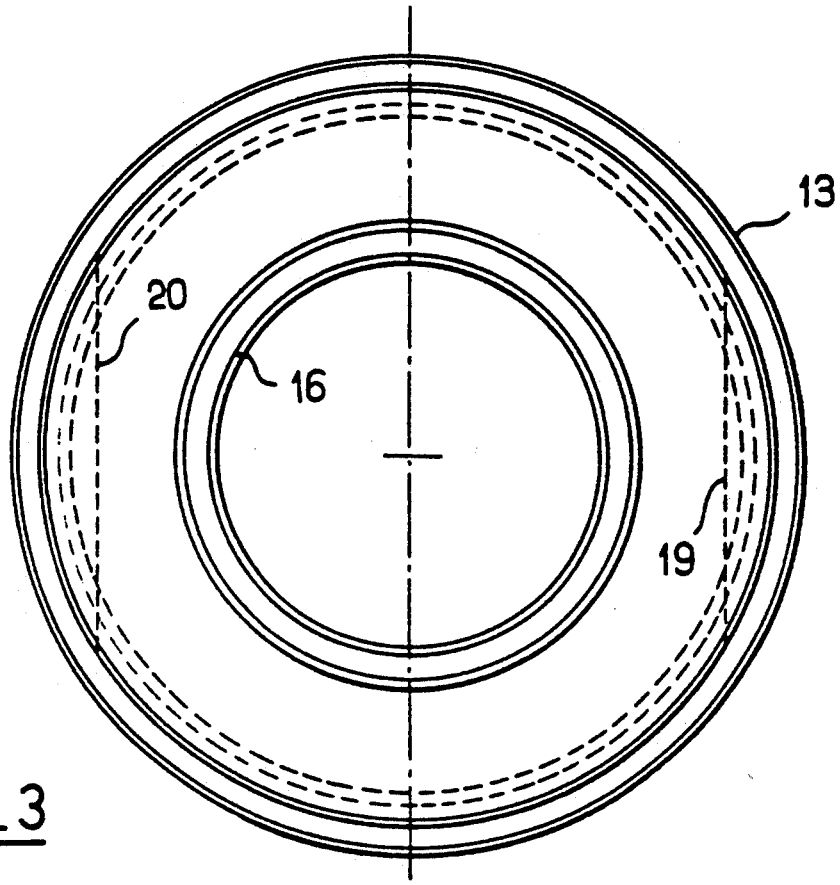
FIG. 3 shows the same component seen from below.
Figure 2:
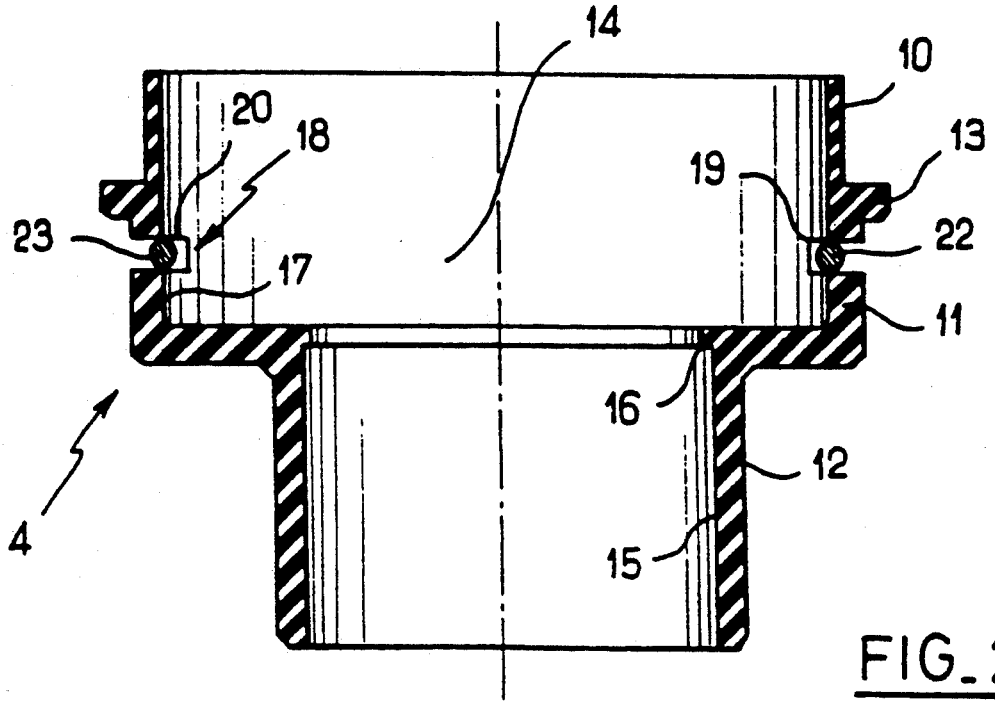
FIG. 2 shows, seen in section, a hollow component according to the invention.

FIGS. 2 and 3 show a preferred hollow component 4 according to the invention, which is in the shape of a shell of revolution. This shell, which is made in a single piece, comprises a lower cylindrical part 10 whose outer diameter is equal to that of the central opening 8 of the bottom 7, a middle cylindrical part 11 of the same inner diameter as the part 10, and an upper cylindrical part 12 whose inner diameter is equal to the diameter of the ignition tube which will be employed in the ammunition, or of a protective tube as described below.

An external abutment 13 is advantageously provided at the junction of the parts 10 and 11, so as to permit the component 4 to rest firmly on the bottom 7 and to permit easy integral attachment, for example by adhesive bonding.

The hollow component 4 advantageously consists of an elastic material such as a rubber. Rubbers given preference will be those satisfying the following conditions: withstanding 3000° C. for 10 milliseconds, being leak-tight up to $7\times10^8$ Pa, or 7000 bars, and being compatible with nitroglycerine. The Applicant Company recommends adhesives of epoxy or cyanoacrylic type for the adhesive bonding of the component 4 to the bottom 7.

Over its entire height the hollow component 4 has a central cavity 14 bounded by the inner walls of the parts 10, 11 and 12.

The inner wall 15 of the upper part 12 advantageously carries an internal abutment 16 intended to facilitate the subsequent fitting of the ignition tube or a protective tube as described below.

Means 18 allowing a separate component to be fastened inside the said central cavity 14 are arranged on the inner wall 17 of the middle part 11 which is situated between the bottom 7 of the cartridge case member 3 and the said internal abutment 16.

Figure 5:
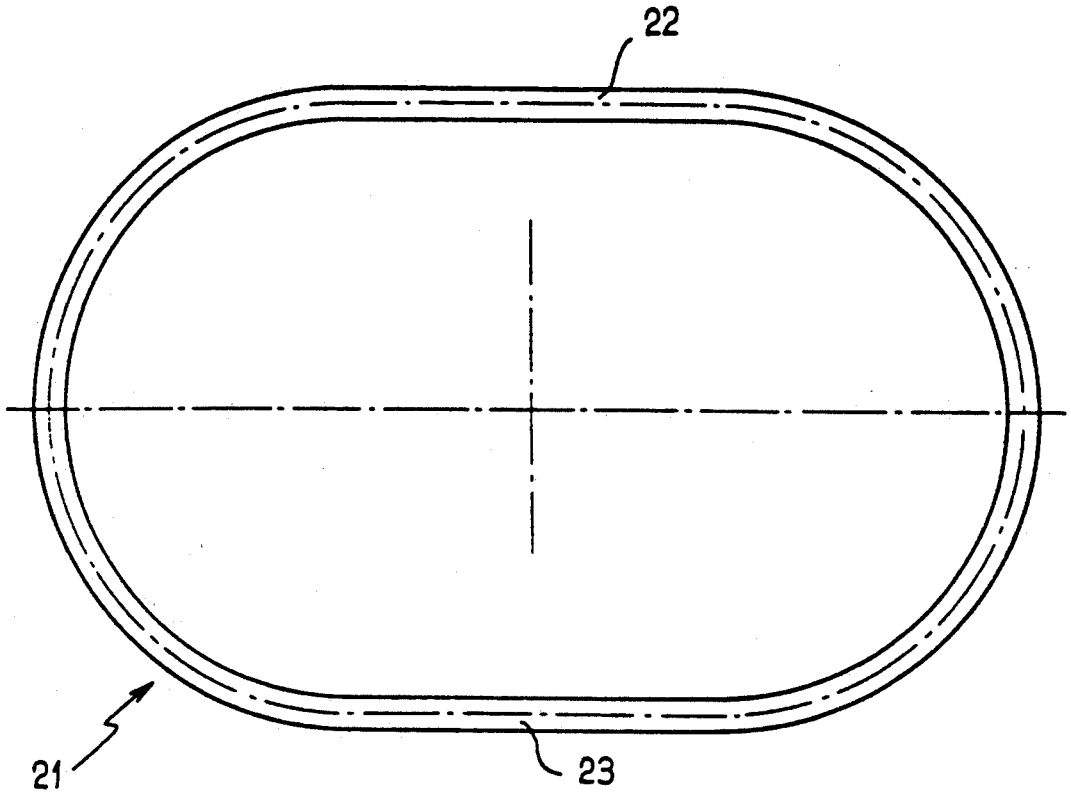
FIG. 5 shows a first means of fastening which may be carried by a hollow component according to the invention.

These means 18 advantageously consist of two rectilinear openings 19 and 20 produced throughout the thickness of the wall of the middle part 11 so as to be parallel and arranged on both sides of the axis of the said shell in the same plane perpendicular to the said axis, as shown in FIG. 3, and of a resilient metal ring 21 comprising two rectilinear parts 22 and 23 forming small bars and engaged in the openings 19 and 20 respectively. Such a metal ring 21 is shown in FIG. 5.

The metal base 2 characteristically carries a hollow central ferrule 24 whose end 25 is frustoconical and which carries a circular groove 26. When the base 2 is fitted, the ferrule 24 enters the cavity 14 of the component 4, its frustoconical end 25 pushes back the resilient small bars 22 and 23 which, after complete introduction of the ferrule, resume their initial position while being inserted into the groove 26 in the base, thus preventing any withdrawal of the latter, the groove 26 of the ferrule 24 thus forming a means of fastening complementary to those carried by the hollow component 4.

In the case of the semicombustible cartridge case shown in FIG. 1, the metal base 2 comprises a flange 27 ending in a seal 28 which is applied against the combustible tube 6.

Furthermore, in order to improve the integral attachment of the bottom 7 to the component 4, a metal washer 29 is advantageously arranged between the bottom 7 and the base 2.

Figure 4:
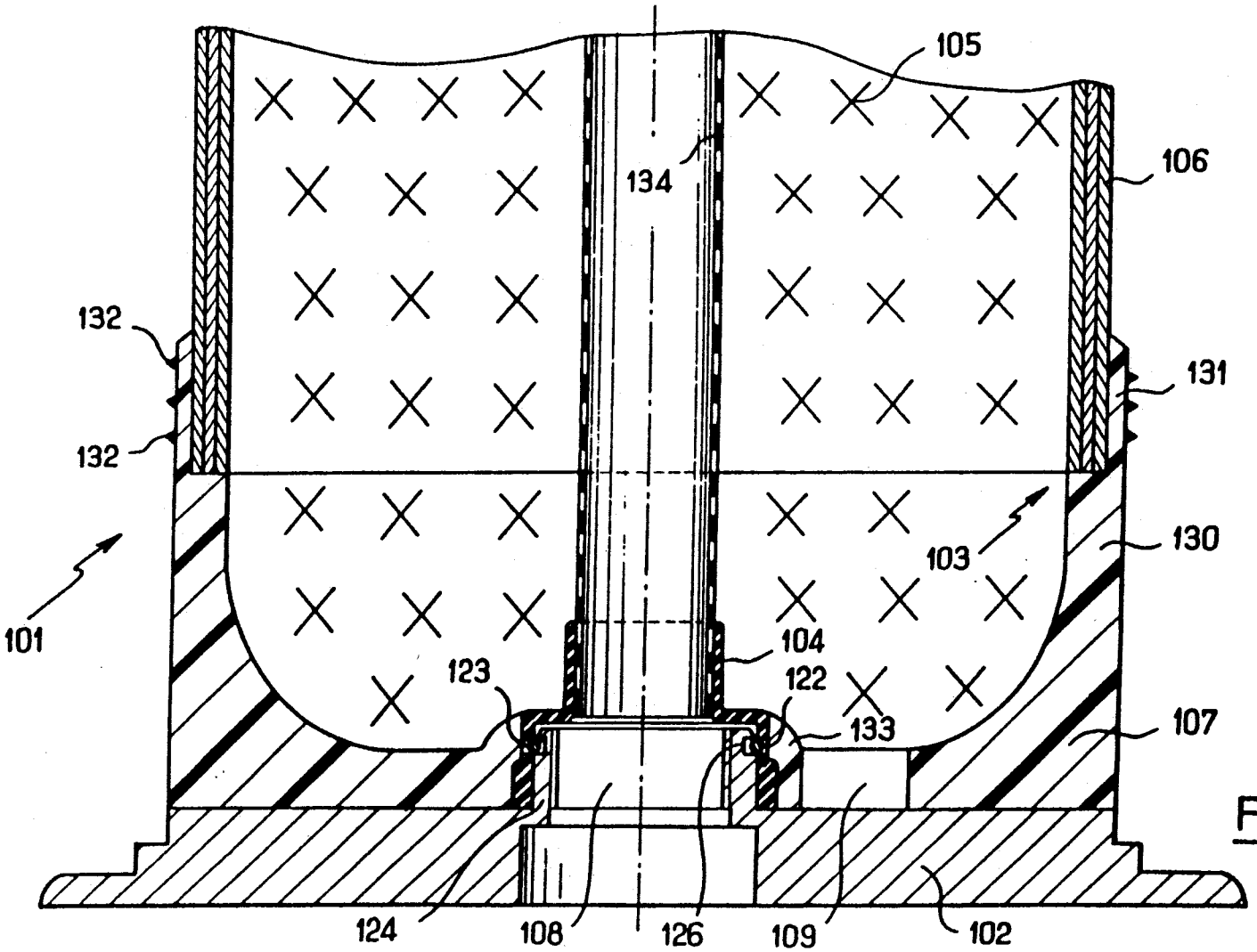
FIG. 4 shows, seen in partial section, a preferred alternative form of embodiment of a semicombustible cartridge case according to the invention.

Shown in FIG. 4, in partial section, is the lower part of a semicombustible cartridge case 101 according to a preferred alternative form of embodiment of the invention. This cartridge case consists chiefly of a metal base 102, of a cartridge case member 103 with a combustible tube and of a hollow component 104. The semicombustible cartridge case is filled with propellent powder 105.

According to this preferred embodiment of the invention, the cartridge case member 103 consists of a combustible tube 106 and of a bottom 107 which consists of an elastic material chosen from the group of the products of polymerisation of chloroprene, of neoprene or of mixtures based on ethylene and propylene, such as EPDM (ethylene-propylene-diene monomer).

In this embodiment the combustible tube 106 is advantageously obtained by spiralling sheets of combustible paper containing nitrocellulose.

The polymer forming the bottom 107 preferably has a Shore hardness of between 40 and 90 Shore units with an elongation greater than 50%. It is furthermore essential that the material constituting the bottom 107 should have a temperature resistance better than 1200° C. for a few seconds. Elastic materials containing a refractory filler such as silica fibres will be preferred for this reason.

The materials preferred by the Applicant Company are polychloroprene rubbers containing between 20 and 60% by weight of silica.

A preferred embodiment of the bottom 107 is that shown in FIG. 4, according to which the bottom 107 has a flat base provided with a circular central opening 108 and with a separate side opening 109 and has a side flange 130 extended by a sealing lip 131. The combustible tube 106 is then placed bearing on the upper part of the side flange 130 and against the inner surface of the sealing lip 131. Adhesive bonding with an epoxy or cyanoacrylic adhesive allows the tube 106 and the bottom 107 to be integrally attached efficiently.

The sealing lip 131 is advantageously provided with at least one external rib 132 on its outer surface.

A hollow component 104 similar to the component 4 described above obviously enters the bottom 107 through the central opening 108 and is integrally attached to the bottom. In this embodiment the hollow component 104 and the bottom 107 can be integrally attached by overmoulding without resorting to adhesive bonding.

Figure 6:
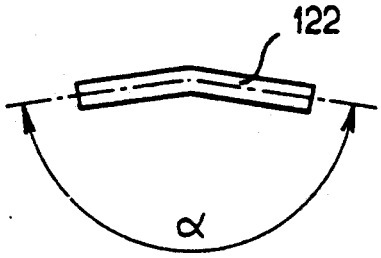
FIG. 6 shows a preferred second means of fastening which may be carried by a hollow component according to the invention.

In this case the resilient small bars 122 and 123 placed in the component 104 may consist merely of V-shaped metal rods placed in the rectilinear openings produced in the component 104 and retained by a shoulder 133 of the bottom 107 overmoulded against the component 104. FIG. 6 shows a small bar 122 according to this preferred embodiment. The two arms of this small bar form between them an angle $\alpha$ (alpha) of 175°.

The metal base 102 then has a very simple shape, since it is essentially in the shape of a flat disc provided with a central opening 108 and extended by a hollow ferrule 124, similar to the hollow ferrule 24 described above, and which carries a circular groove 126 forming the additional fastening means for the small bars 122 and 123.

A semicombustible cartridge case according to this preferred alternative form of the invention offers the twin advantage of very great simplicity of manufacture and very high efficiency of leaktightness at the rear of the shell during firing. In fact, at the time of firing, the sealing lip 131, especially when it is provided with ribs 132, ensures leaktightness at low pressure by being laid against the chamber of the weapon, then the side wall 130 of the bottom 107 ensures leak-tightness at intermediate pressure in the same manner and, finally, the metal base 102 ensures leaktightness at high pressure. A cartridge case is thus available which ensures a perfect leaktightness throughout the pressure ranges.

Although their preferred application lies in the field of semicombustible ammunition, the cartridge case members according to the invention can also be employed for wholly combustible cartridge cases with a combustible base, especially when the bottom 7 of the said member is itself combustible.

Ammunition with a semicombustible cartridge case according to the invention consists essentially of a shell and of a semicombustible cartridge case (1, 101) according to the invention.

As already seen above, a semicombustible cartridge case according to the invention is made up of a cartridge case member 3 or 103, as described above, of a metal base 2 or 102 carrying a hollow central ferrule 24 or 124 which enters the cavity of the hollow component 4 or 104, and which comprises fastening means 26 or 126 which are complementary to those carried by the said hollow component. As already stated above, the semicombustible cartridge case contains an igniting powder 5 or 105, an ignition tube and an igniter plug. The ignition tube is shown by reference 34 in FIG. 1 and by reference 134 in FIG. 4. For the sake of clarity, the igniter plug has not been shown in the FIGS. but is housed in the central opening 8 or 108 of the base 2 or 102 respectively.

An essential advantage provided by the invention is the simplicity of production of, and of filling with powder, dart-shell ammunition which has finning entering deeply into the combustible tube.

Figure 7B:
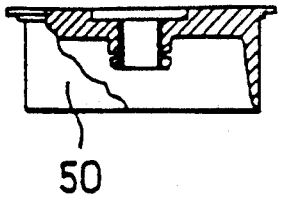
FIGS. 7A and 7B show diagrammatically the application of the process according to the invention in the case of dart-shell semicombustible ammunition and a sectional view of the metal base for attachment to the bottom of the hollow component.

The process for assembling and for filling, according to the invention, such ammunition has been illustrated diagrammatically in FIG. 7.

Dart-shell ammunition 40 can be seen in partially cutaway view. The dart shell is made up of the dart 41, a shoe 42 fastened to a combustible tube 44 and finning 43 entering deeply into the combustible tube 44 of a cartridge case member according to the invention. This tube 44 is obtained by spiralling combustible paper tapes and ends in a bottom 45 made of elastic material according to a preferred alternative form of the invention. The tube 44 and the bottom 45 form the cartridge case member according to the invention.

Figure 7A:
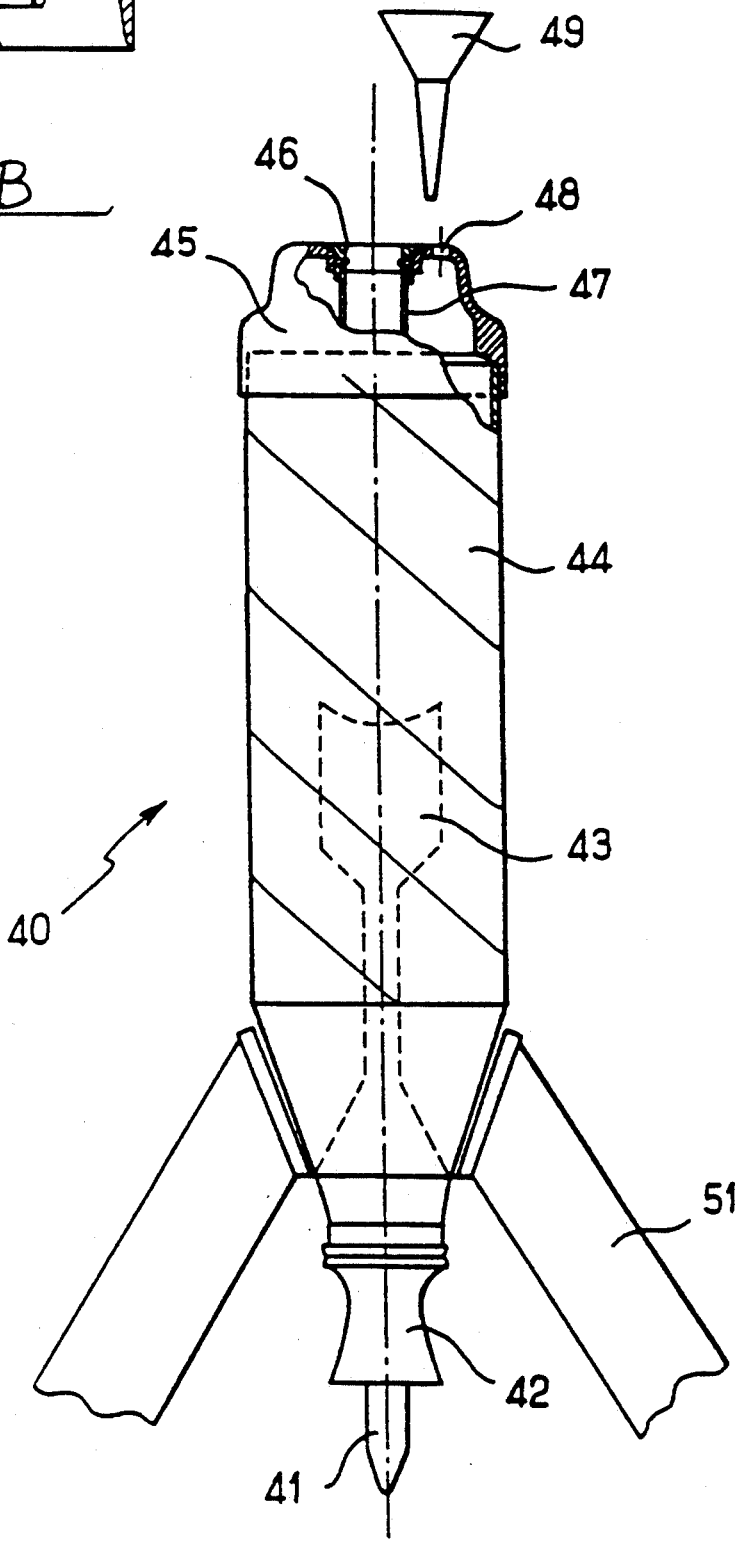

In the cutaway part of the bottom 45 can be seen a hollow component 46 according to the invention. The propellent powder has not yet been introduced into the cartridge case member, but the space needed for the ignition tube has been reserved by fastening a tube 47 in the extension of the hollow component 46. This tube 47 may be the actual ignition tube or a protective tube inside which the ignition tube carried by the igniter plug will be housed. When the ammunition 40 thus made up is positioned as shown in FIG. 7A, that is to say with the shell downwards, on a carrier 51, it is then easy to fill the whole of the free volume of the cartridge case member with propellent powder by virtue of a funnel 49 entering the side opening 48 carried by the bottom 45. When this operation is completed, the metal base 50 (FIG. 7B) can then be fastened to the bottom 45 by virtue of the inner ferrule of this bottom, which will enter the hollow component 46 as was explained above.

The igniter plug can then be fastened to the base 50 so as to obtain the semicombustible ammunition ready for use. An additional advantage of the invention exists when the space needed for the ignition tube is reserved by means of a protective tube which does not allow the powder to pass. In this case the ammunition 40 can be transported or stored unprimed without an igniter plug, the latter being incorporated in the ammunition only at the time of use, which increases the safety offered by the ammunition according to the invention.

In any event, it should be noted that the assembly of such dart-shell semicombustible ammunition requires no cutout in the combustible tube 44, no introduction of any component by force into the propellent powder, and is found to be easy to automate.

I claim:

1. Ammunition comprising a semi-combustible cartridge case, a shell and an ignition tube, said semi-combustible cartridge case comprising a combustible tube having a bottom which has a central opening, said bottom including a separate side opening beside and spaced from said central opening, a hollow component mounted about said central opening and without obstructing said side opening, said hollow component comprising a hollow cavity along its entire length bounded by an internal wall, said internal wall having means for fastening a metal base inside said central cavity, said means for fastening comprising two substantially parallel rectillinear openings disposed on each side of an axis of said hollow component in the same plane and perpendicular to said axis and two resilient bars, disposed in said openings, said ammunition comprising a metal base carrying a central hollow ferrule with said ferrule projecting into said central cavity of said hollow component and which includes cooperating means for cooperating with said two resilient bars so as to receive said bars to retain said ferrule and said base in said central cavity.

2. Ammunition according to claim 1, characterised in that said hollow component (4) is an elastic component.

3. Ammunition according to claim 2, characterised in that said hollow component (4) is a shell of revolution.

4. Ammunition according to claim 3, characterised in that an internal wall (17) of said hollow component comprises an internal abutment (16) and in that the said fastening means (18) are situated between said bottom (7) and the said internal abutment (16).

5. Ammunition according to claim 1, characterised in that said tube (6) and the said bottom (7) are integrally formed.

* * * * *